US006942125B2

(12) United States Patent
Marelli

(10) Patent No.: US 6,942,125 B2
(45) Date of Patent: Sep. 13, 2005

(54) MANUALLY OPERABLE INVERTIBLE PUMP FOR DISPENSING ATOMIZED LIQUIDS

(75) Inventor: Andrea Marelli, Rozzano (IT)

(73) Assignee: Microspray Delta S.p.A., Fizzonasco Di Pieve Emanuele (IT)

( * ) Notice: Subject to any disclaimer, the term of this patent is extended or adjusted under 35 U.S.C. 154(b) by 0 days.

(21) Appl. No.: 10/946,246

(22) Filed: Sep. 22, 2004

(65) Prior Publication Data

US 2005/0087564 A1 Apr. 28, 2005

(30) Foreign Application Priority Data

Oct. 24, 2003 (IT) ..... MI2003A2082

(51) Int. Cl.[7] ..... B65D 5/40

(52) U.S. Cl. ..... 222/321.4; 222/376

(58) Field of Search ..... 222/321.4, 376

(56) References Cited

U.S. PATENT DOCUMENTS

| | | | | |
|---|---|---|---|---|
| 4,277,001 A | * | 7/1981 | Nozawa | 222/321.4 |
| 4,371,098 A | | 2/1983 | Nozawa et al. | |
| 4,775,079 A | * | 10/1988 | Grothoff | 222/321.4 |
| 5,222,636 A | * | 6/1993 | Meuresch | 222/321.4 |
| 5,738,252 A | * | 4/1998 | Dodd et al. | 222/376 |

FOREIGN PATENT DOCUMENTS

| | | |
|---|---|---|
| EP | 0 053 350 | 6/1982 |
| EP | 0234959 | 9/1987 |
| EP | 0 648 545 | 4/1995 |
| EP | 1 029 597 | 8/2000 |
| JP | 53 10113 | 1/1978 |

* cited by examiner

*Primary Examiner*—Philippe Derakshani
(74) *Attorney, Agent, or Firm*—Oblon, Spivak, McClelland, Maier & Neustadt, P.C.

(57) ABSTRACT

Manually operable invertible pump for dispensing atomized liquids, the pump having a very compact structure and a flexible diaphragm valve for controlling liquid entry into the pump when this is in an inverted or partly inverted position.

4 Claims, 3 Drawing Sheets

MANUALLY OPERABLE INVERTIBLE PUMP FOR DISPENSING ATOMIZED LIQUIDS

FIELD OF THE INVENTION

The present invention relates to a manually operable invertible pump for dispensing atomized liquids withdrawn from a liquid container, on the mouth of which the pump is mounted usable both in the upright position, i.e. with the pump facing upwards from the container, and in the inverted position, i.e. with the pump facing downwards from the container.

BACKGROUND OF THE INVENTION

Many types of invertible pumps are known, such as those described in U.S. Pat. No. 5,222,636, U.S. Pat. No. 4,775,079, U.S. Pat. No. 4,277,001, U.S. Pat. No. 5,738,252, EP-A-0648545 and EP-A-1029597, however such pumps have serious drawbacks which limit their production and use. In this respect, some are of very complex structure with many component parts difficult to mould and assemble; others entrust the seal to small, light sleeves slidable on the surfaces of a holed cylindrical body, the mobility of such sleeves being very precarious and unreliable; still others are of considerable size below the seal gasket of the ring cap for fixing the pump onto the mouth of a liquid container, either axially (see the two said European patents and U.S. Pat. No. 4,277,001 and U.S. Pat. No. 4,775,079) or transversely (U.S. Pat. No. 5,222,636), making them unsuitable for use on small dimension containers such as those required, for example, in the perfumery field.

The operation of an invertible pump depends on the fact that the liquid enclosed in a container must be able to penetrate into the pump compression chamber by rising along a dip tube (of which one end is mounted on the pump and the other end is free and is positioned in proximity to the container base) when the pump is upright above the container, but to penetrate directly into said compression chamber from a hole provided in the pump body, and of which the opening is controlled by a unidirectional valve which opens only during pump intake and only when the pump is inverted, i.e. positioned below the container.

SUMMARY OF THE INVENTION

The main object of the present invention is to provide an invertible pump having a structure which is very simple to mould and assemble, and of easy and economical construction, and in particular having a length and width (below and respectively laterally to the pump body) which only slightly exceed the dimensions of a similar non-invertible pump.

This and other objects are attained by an invertible pump comprising a main body defining a chamber for the intake and compression of determined quantities of the liquid to be dispensed, a dip tube connected to said chamber via a hole provided in the base wall of the main body and via a first unidirectional valve system which enables the liquid to arrive in said chamber through the dip tube when the pump is upright but prevents liquid arrival when the pump is inverted, there being provided in the main body an aperture provided with a second unidirectional valve system which enables the liquid to directly arrive in the compression chamber when the pump is inverted but prevents this arrival when the pump is upright, wherein said second valve system comprises a cup-shaped body sealedly mounted on the outer peripheral surface of the main body to define with the adjacent extremity on the said main body an annular chamber housing and retaining a flexible element which when the pump is at rest or being used in the upright position is elastically urged to seal against a profiled edge provided on the base wall of the cup-shaped body, said annular chamber being in direct communication with said intake and compression chamber via an aperture provided in the main body, in the base of the cup-shaped body there being provided a first hole to which said dip tube is connected and a second hole which is open and in direct communication with said chamber aperture when the pump is inverted and is operated to draw liquid into the chamber of the main body, the flexible element having a central hole which enables said chamber to sealedly communicate with the dip tube through the first valve system.

Preferably, a tubular element is provided projecting from one and the other side of said central hole of the flexible element, the two free ends of said tubular element being sealedly fixed rigidly to the dip tube and, respectively, to that hole of the main body to which the tube is connected.

BRIEF DESCRIPTION OF THE SEVERAL VIEWS OF THE DRAWINGS

The structure and characteristics of the invertible pump of the present invention will be more apparent from the ensuing descriptions of two non-limiting embodiments thereof, given with reference to the accompanying drawings, in which.

DETAILED DESCRIPTION OF THE INVENTION

Figure 1:
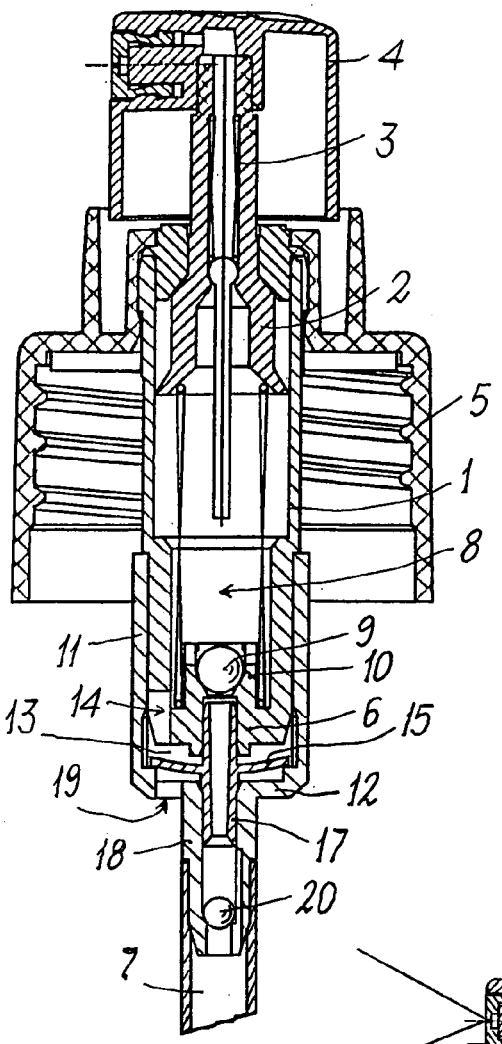
FIGS. 1 and 2 are longitudinal sections through a pump in the upright position, shown respectively at rest and with its piston pressed completely down to dispense an atomized liquid.

The pump shown in Figures from 1 to 4 comprises a main body 1 housing a sealedly slidable piston 2, from which there extends a hollow stem 3, the free end of which is inserted into a suitable seat provided in a dispensing cap 4: the body 1 can be rigidly fixed by a threaded ring cap 5 onto the mouth of a container (not shown for simplicity) for the liquid to be dispensed.

The main body 1 is lowerly bounded by a base wall 6, in the centre of which there is provided a hole connectable to a dip tube 7 which enables the liquid present in the container to rise (when the pump is in the upright position of FIGS. 1 and 2) through the hole in the base wall 6 and to penetrate into the liquid intake and compression chamber bounded within the body 1 by the piston 2 and by a unidirectional seal valve which, in the illustrated example, consists of a small plastic ball 9 housed and axially translatable within a housing 10 projecting from the base wall 6, where a profiled seat is provided on which the ball 9 rests and forms a seal when a liquid present in the chamber 8 is put under pressure by operating the cap 6 and with it the stem 3 and piston 2. The pump as described up to this point is of known type and can be structured in various ways: for example that shown in FIGS. 1–4 is totally similar to that illustrated in EP-B-0721803 (but could be as that illustrated in EP-A-1334774, EP-A-0648545, U.S. Pat. No. 3,627,206 or many others).

The new and characteristic part of the pump of the invention relates to the lower part of the pump (with reference to the pump in its upright position of FIGS. 1 and 2), where it can be seen that on the outer surface of the main body 1 there is sealedly mounted a cup-shaped body 11 having a base wall 12 which defines an annular chamber 13 with the adjacent end of the body 1, the chamber 13 being in free communication with the chamber 8 via an aperture 14 provided in the main body 1 and left free by the cup-shaped body.

Between the base wall 12 of the cup-shaped body 11 and the adjacent end of the main body 1 there is housed a flexible discoidal element 15 having a central hole, from one and the other side of which there project two small tubular elements 16, 17, one of which is sealedly inserted and securely retained in a suitable seat (for simplicity not numbered, but clearly visible in the drawings) provided in the base wall 12 of the body 1 where a hole (also not numbered) is provided at the centre of the housing 10, on the profiled seat of which the ball 9 can form a seal; whereas the other tubular element 17 is inserted into and sealedly retained in the cavity of a hole provided at the centre of the base wall 12, from this hole there extending a hollow appendix 18, on the end of which the dip tube 7 is mounted.

From FIGS. 1–4 it can be seen that from the base wall 12 of the body 11 there projects (towards the body 1) a profiled rim consisting of an annular step against which the discoidal element 15 is elastically urged to form a seal: the elastic pressure of the peripheral edge of the discoidal element 15 on said profiled rim is ensured by the fact the element 15 is rigid with the two tubular elements 16, 17 which are rigidly fixed in the seats into which they are inserted.

From the figures it can also be seen that in the base wall 12 of the cup-shaped body there is provided a hole 19 and that the hollow appendix 18 houses an axially translatable small ball 20, which cannot escape from the cavity in the appendix because inside this appendix there is provided a ledge or the like on which the ball can rest (with the pump upright) without however closing the hole of the appendix, in which one or more longitudinal grooves are provided (not numbered for simplicity but clearly visible in the drawings), to leave the passage free for the liquid which rises from the dip tube to the pump.

Figure 3:
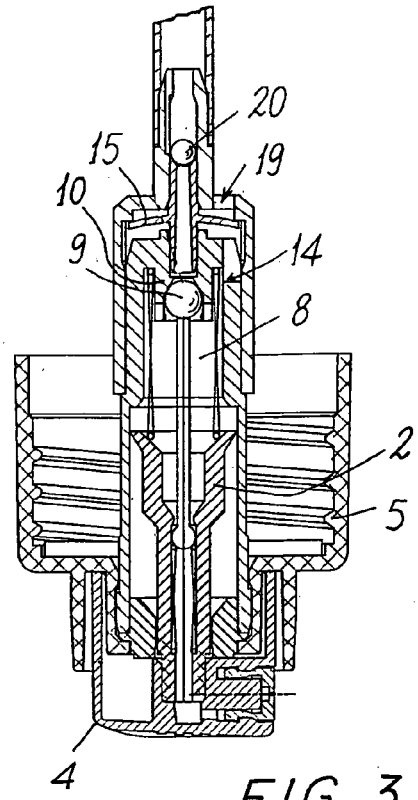
FIGS. 3 and 4 are similar to FIGS. 1 and 2, but show the pump inverted in the same utilization state as the preceding figures.
Figure 4:
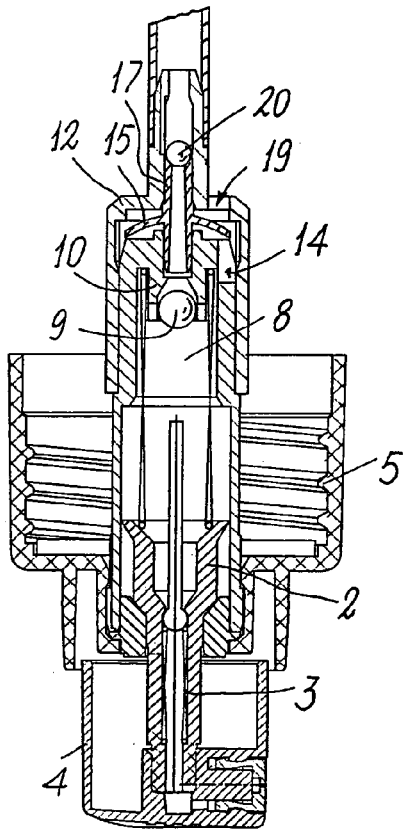

Finally it can be seen that on the free end of the tubular element 17 there is provided a profiled seat on which the ball 20 can rest and form a seal when the pump is used in the inverted position (FIGS. 3 and 4).

Before describing the operation of the invertible pump it is important to note the great simplicity of its structure and its ease of assembly. In this respect, the ball 20 can be inserted into the appendix 18 by simply allowing it to fall freely into the cup-shaped body 11 before this is mounted in the pump; the tubular element 16 can be easily inserted into its seat in the pump, either before mounting the cup-shaped body on the pump, or by firstly inserting and locking the tubular element 17 in its seat in the hollow appendix 18 and then mounting the cup-shaped body on the pump, so automatically inserting the tubular element 16 in its seat.

It should be noted that the transverse and longitudinal dimensions of the invertible pump are only slightly greater than those of a common non-invertible pump of similar structure.

It will now be assumed that the pump is in the upright vertical position (FIGS. 1 and 2), mounted on a container of liquid to be dispensed.

Figure 2:
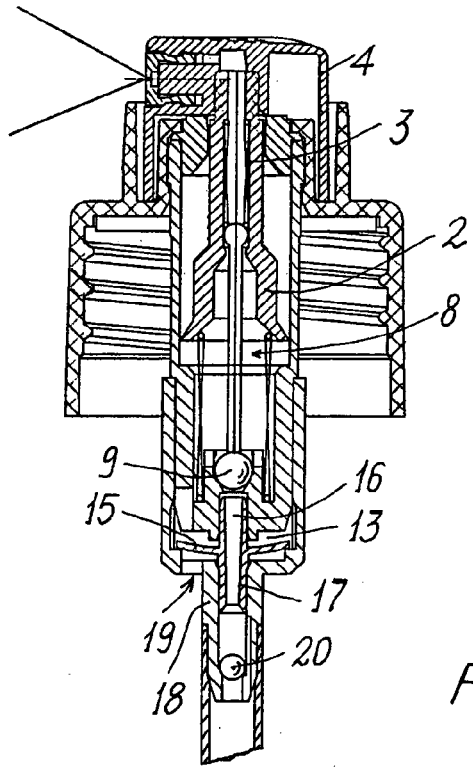

To prime the pump, the cap 4 is pressed with a finger to lower the piston 2 from the position of FIG. 1 to that of FIG. 2, while the air initially present in the pump chamber is expelled to the outside in traditional known manner, as described in a large number of patents, including those already cited.

Starting from the position of FIG. 2, it will be assumed that the cap is now released so that the pump piston is made to rise by a spring which acts on it: in this manner, a vacuum is formed in the chamber 8 to cause the liquid to rise along the dip tube 7, bypassing the ball 20 and raising the ball 9, to penetrate into and fill the chamber 8.

With the pump hence primed and upright, the pump is again operated to pressurize the liquid present in the chamber 8 and force the ball 9 to press and seal against its seat: the liquid which fills the annular chamber 13 and is in communication with the chamber 8 via the aperture 14 cannot escape to the outside of the pump body because the flexible discoidal element 15 is urged by the pressurized liquid to seal against the annular projection provided on the base of the cup-shaped body.

The pump can hence be used in the same manner as a common non-invertible pump of similar structure.

Reference will now be made to FIGS. 3 and 4 in which the pump is shown in its inverted position, i.e. with the pump body immersed in the liquid contained in the container and with the free end (not shown) of the dip tube 7 free and open in the air present in the container bottom, now positioned at the top: under these conditions the ball 20 rests and seals against its seat provided on the end of the tubular element 17. Starting from the position of FIG. 3 and with the pump already primed, when pressure is released from the cap 4 the piston begins to descend along the intake chamber and the discoidal element 15 passes from its sealing position of FIG. 3 (in which it is elastically urged against the profiled rim projecting from the base wall 12, so preventing communication between the hole 19 and the aperture 14) to that of FIG. 4 in which the discoidal element 15 is curved and raised from the said profiled rim by the effect of the vacuum created in the intake chamber 8. In this manner the liquid can pass freely through the hole 19 and aperture 14 to fill the chamber 8: when piston translation within the main pump body ceases, the discoidal element 15 returns elastically and automatically to its rest position in which it sealedly closes the hole 19. It should again be noted that during this intake stage, the air present in the container cannot enter the chamber 8 because the ball 20 seals against the seat on the tubular element 17 or at least creates a strong resistance to air passage.

When the pump is pressed to dispense atomized liquid, the pressurized liquid present in the chamber 8 urges the discoidal element 15 against the profiled rim of the cup-shaped body (hence increasing the seal effect) and lifts the ball 9, which becomes inserted into and seals against its seat in the housing 10, this position being maintained until the piston 2 reaches its end-of-travel position (FIG. 3).

Finally it can be seen that even during initial priming of the pump in its inverted position, the ball 20 seals against the end of the tubular element 17, while the discoidal element passes from its sealing position (with the piston pressed totally down as in FIG. 3) to the raised position of FIG. 4, so enabling liquid to enter the intake chamber 8 through the hole 19 and the aperture 14.

Figure 5:
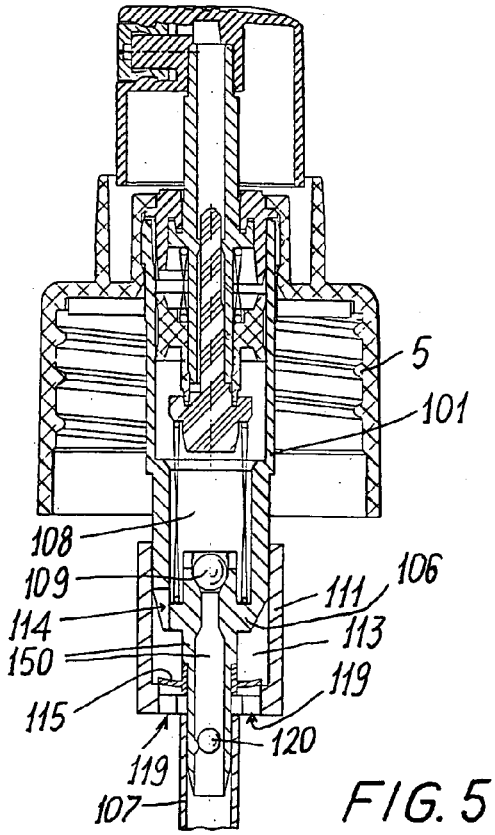
FIG. 5 is similar to FIG. 1, but shows a different embodiment of the invertible pump.

From that stated and illustrated, it is clear that the length of the invertible pump is very small, only slightly more than that of a common non-reversible pump, thus facilitating its use in many cases (for example in the pharmaceutical and cosmetics fields), and also facilitating its storage, its handling and its despatch from the manufacturer to the user. FIG. 5 shows a different (but similar) embodiment of the pump of FIGS. 1–4.

The pumping system applied to the hollow main body 101 will not be described as it is the same as that illustrated in EP-A-1334774 (but could also have a different configuration). Again, in this embodiment the body 101 defines an intake and compression chamber 108 and presents an aperture 114 which is left free by a cup-shaped body 111 sealedly mounted on the lower end of the body 101.

An elongate hollow appendix 150 projects from the base 106 of the body 101 and houses two small sealing balls 109, 120 (identical to the already described balls 9 and 20 and having the same function): a dip tube 107 is sealedly mounted on the free end of the appendix 150, there also being mounted on said aperture (but positioned within the cup-shaped body 111) a flexible discoidal element with a central hole (to enable it to be mounted on the appendix 150), its free ends when in the rest condition being elastically urged to form a seal against a profiled rim projecting from the base of the cup-shaped body, so preventing communication between one or more holes 119 provided in the base of the cup-shaped body and the chamber 113, which is in direct communication with the aperture 114.

It is not necessary to describe the operation of the pump of FIG. 5, it being the same as that of the pump shown in FIGS. 1–4.

In the pump shown in Figures from 1 to 4, the liquid drawn through the dip tube 7 passes through the open free end of the hollow appendix 18, flows around the ball 20 and then rises above the ball 20 to enter the intake chamber 8. The liquid takes an identical path from the dip tube to the intake chamber in the pump of FIG. 5.

In both cases however, the free end of the pump hollow appendix on which the dip tube is sealedly mounted could also be closed, while achieving the same result.

Figure 6:
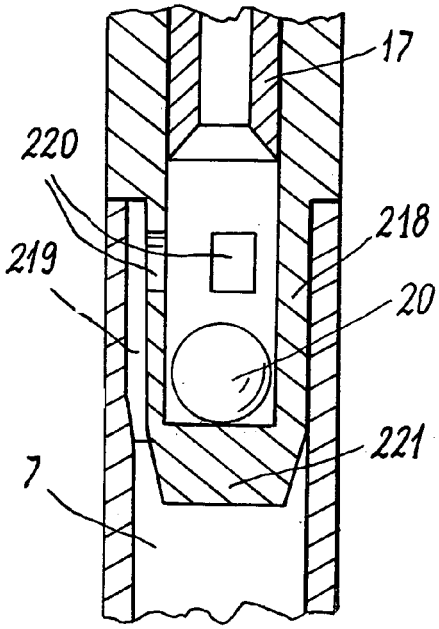
FIGS. 6 and 7 are longitudinal sections through just the lower end portion of a variant of the pump of FIGS. 1 and 2, shown in the upright and inverted position respectively.
Figure 7:
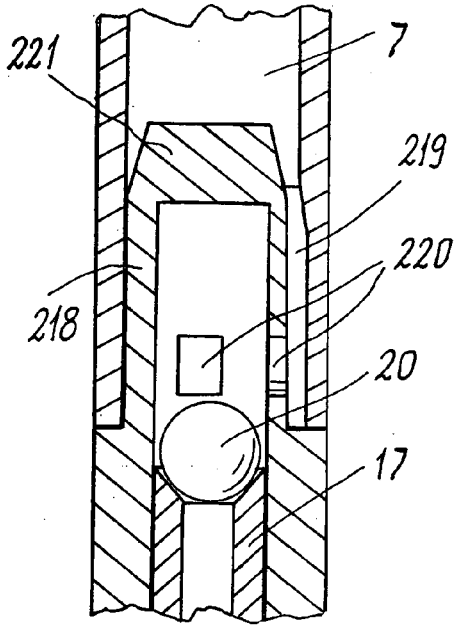

For example, with reference to FIGS. 6 and 7 which show only the end portion of the pump of FIGS. 1–4, it can be seen that the end portion of the tubular element 17 (the same reference numeral is used as already used in FIGS. 1–4 to clarify the understanding of this variant without illustrating the structure and operation of the entire pump, which is exactly as already described in relation to these figures) is inserted into a hollow cavity (projecting from a cup-shaped body, not shown for simplicity) indicated by the reference numeral 218 and is closed by an end wall 221, hence defining a cylindrical cavity in which the ball 20 is movably housed. Grooves 219 (only one of which is shown in longitudinal section in FIGS. 6 and 7) are provided in the outer surface of the hollow appendix 218, each opening in correspondence with a respective aperture 220 which connects the internal cavity of the appendix 218 to each groove 219.

In FIG. 6, the ball is shown in the position it assumes when the pump is operated in the upright position: it can be seen that the liquid is drawn into the pump through the dip tube 7, passes through the groove 219 and penetrates into the hollow appendix 218 through the apertures provided in an intermediate position along the length of the hollow appendix so as not to be obstructed by the ball 20.

FIG. 7 is similar to FIG. 6 but shows the position assumed by the ball 20 when the pump is used in the inverted position.

FIGS. 6 and 7 relate to the embodiment of FIGS. 1–4, however the same structural variant (i.e. the presence of the grooves on the outside of the hollow appendix on which the dip tube is mounted, and the presence of apertures which pass through the thickness of the hollow appendix in correspondence with said grooves) can evidently also be applied if the pump is that shown in FIG. 5.

What I claim is:

1. A manually operable invertible pump for dispensing an atomized liquid comprising a main body defining a chamber for the intake and compression of determined quantities of the liquid to be dispensed, a dip tube connected to said chamber via a hole provided in the base wall of the main body and via a first unidirectional valve system which enables the liquid to arrive in said chamber through the dip tube when the pump is upright but prevents liquid arrival when the pump is inverted, there being provided in the main body an aperture provided with a second unidirectional valve system which enables the liquid to directly arrive in the compression chamber when the pump is inverted but prevents this arrival when the pump is upright, wherein said second valve system comprises a cup-shaped body sealedly mounted on the outer peripheral surface of the main body to define with the adjacent extremity on the said main body an annular chamber housing and retaining a flexible element which when the pump is at rest or being used in the upright position is elastically urged to seal against a profiled edge provided on the base wall of the cup-shaped body, said annular chamber being in direct communication with said intake and compression chamber via said aperture provided in the main body, in the base of the cup-shaped body here being provided a first hole to which said dip tube is connected and a second hole which is open and in direct communication with said aperture of the chamber when the pump is inverted and is operated to draw liquid into the chamber of the main body, the flexible element having a central hole which enables said chamber to sealedly communicate with the dip tube through the first valve system.

2. An invertible pump as claimed in claim 1, wherein said first unidirectional valve system consists of a hollow elongate element projecting from one and the other side of the base wall of the main body at said hole provided in said base wall, in correspondence with each of the two ends of said hollow elongate element there being provided a housing which contains and retains a ball movable between a position in which it rests on and seals against a profiled seat provided in said housing and a position in which it has moved away from said profiled seat to free the adjacent end of the cavity of the hollow elongate element, the cavity of that end of the elongate element being connected to the cavity of one end of the dip tube.

3. An invertible pump as claimed in claim 2, wherein said hollow elongate element comprises a tubular element projecting from one and the other side of said central hole of the flexible element, the two free ends of said tubular element facing said ball and said ball respectively.

4. An invertible pump as claimed in claim 1, wherein from said first hole provided in the base wall of the cup-shaped body there projects a hollow appendix which is closed by an end wall and on which an end of said dip tube can be sealedly mounted to feed the liquid to be dispensed to said chamber through said first unidirectional valve system, there being provided on the outer surface of said hollow appendix at least one groove extending from the closed end of the hollow appendix to an aperture provided in the said hollow appendix and connecting the cavity of said appendix to said groove, said aperture being provided in said appendix in an intermediate position along its length.

* * * * *